US012428208B1

(12) United States Patent
Joshi et al.

(10) Patent No.: US 12,428,208 B1
(45) Date of Patent: Sep. 30, 2025

(54) BEVERAGE CONTAINER HAVING DRY INGREDIENT STORAGE FOR MIXING THEREOF

(71) Applicants: Shailendra Joshi, Ho Ho Kus, NJ (US); Vidur Joshi, Ho Ho Kus, NJ (US)

(72) Inventors: Shailendra Joshi, Ho Ho Kus, NJ (US); Vidur Joshi, Ho Ho Kus, NJ (US)

( * ) Notice: Subject to any disclaimer, the term of this patent is extended or adjusted under 35 U.S.C. 154(b) by 189 days.

(21) Appl. No.: 18/233,547

(22) Filed: Aug. 14, 2023

(51) Int. Cl.
*B65D 51/28* (2006.01)
*B65D 43/02* (2006.01)
*B65D 53/00* (2006.01)

(52) U.S. Cl.
CPC ..... *B65D 51/2864* (2013.01); *B65D 43/0231* (2013.01); *B65D 53/00* (2013.01)

(58) Field of Classification Search
CPC ..... B65D 51/2864; B65D 43/0231; B65D 51/2871; B65D 51/2857; B65D 51/2807; B65D 81/3222; B65D 51/2835
USPC ..... 206/219, 221
See application file for complete search history.

(56) References Cited

U.S. PATENT DOCUMENTS 6,644,471 B1 * 11/2003 Anderson ..... B65D 51/2835 206/219
7,588,142 B1 * 9/2009 Bush ..... B65D 51/2857 215/DIG. 8
8,123,054 B2 * 2/2012 Smith ..... B65D 47/2018 215/DIG. 8
8,387,786 B2 * 3/2013 Fontana ..... B65D 51/2892 215/DIG. 8
8,714,808 B2 * 5/2014 Yamanaka ..... B65D 51/2821 366/130
9,132,950 B1 * 9/2015 Anderson ..... B65D 81/32
10,086,980 B2 * 10/2018 Isogai ..... B65D 39/08
2010/0276308 A1 * 11/2010 Lee ..... B65D 51/2864 206/219
2015/0203254 A1 * 7/2015 Lee ..... B65D 41/00 215/227
2015/0266651 A1 * 9/2015 Lee ..... B65D 81/3255 215/227
2024/0351759 A1 * 10/2024 Presche ..... B65D 51/2864

* cited by examiner

*Primary Examiner* — Steven A. Reynolds
(74) *Attorney, Agent, or Firm* — Gulf Coast Intellectual Property Group

(57) ABSTRACT

A beverage container that is configured to store and dispense a material into a liquid stored therein. The invention includes a cap assembly wherein the cap assembly further includes a storage compartment operably mounted within the neck of the beverage container. The storage compartment has operably disposed thereto a plunger member. A cap member is present and includes extraction members formed thereon. The cap member is movable along the neck of the beverage container wherein movement of the cap member engages a plunger keeper effecting the removal of the plunger keeper upon movement of the cap member in the required direction. The plunger member is configured to sealably couple with the walls of the storage compartment providing isolation of the interior volume thereof. An alternate embodiment of the plunger member is further included wherein the alternate embodiment of the plunger member is removed from the beverage container.

14 Claims, 6 Drawing Sheets

BEVERAGE CONTAINER HAVING DRY INGREDIENT STORAGE FOR MIXING THEREOF

FIELD OF THE INVENTION

The present invention relates generally to beverage containers, more specifically but not by way of limitation, a beverage container that is configured to store dry ingredients in a separate compartment and wherein immediately prior to consumption of the beverage the dry ingredients are mixed with the liquid in the beverage container.

BACKGROUND

Nutritional supplements and beverages are a multi-billion dollar industry. Commercially available products range from oral supplements such as vitamins, powders for water and other liquids and premade health drinks containing various vitamins and minerals. While premade health beverages do have some benefits, there are areas where these products are deficient.

Many nutritional supplements degrade in aqueous form. Substances such as but not limited to natural antioxidants and plant products poly phenols. Additionally, melatonin and some other vitamins are known to degrade in aqueous form.

Supplemental beverages that have the supplements dissolved in solution months prior to consumption fail to deliver the full potency of the supplements. Current manufacturing, packaging and distribution of beverages results in a product that has degraded supplements. An ability to mix ingredients at the time of consumption would deliver fresh high quality organic supplements mixed into liquid at the time of consumption which would significantly reduce degradation of the supplements.

Accordingly, there is a need for a beverage container that can isolate dry ingredients until consumption is desired and subsequently facilitate introduction of the dry ingredients into the liquid stored in the beverage container for mixing and consumption thereof.

SUMMARY OF THE INVENTION

It is the object of the present invention to provide a beverage container that is configured to provide mixing of a first ingredient into a liquid immediately prior to consumption wherein the present invention includes a container configured to store a volume of liquid therein.

Another object of the present invention is to provide a beverage container operable to facilitate storage of a dry ingredient and provide introduction thereof into a liquid wherein the present invention includes a cap assembly having a storage compartment integrated into the opening of the beverage container.

A further object of the present invention is to provide a beverage container that is configured to provide mixing of a first ingredient into a liquid immediately prior to consumption wherein the cap assembly includes a plunger member disposed therein.

Yet a further object of the present invention is to provide a beverage container operable to facilitate storage of a dry ingredient and provide introduction thereof into a liquid wherein the plunger member is operably coupled to the cap member of the beverage container.

Still another object of the present invention is to provide a beverage container that is configured to provide mixing of a first ingredient into a liquid immediately prior to consumption wherein the cap member is moved in a first direction to release the ingredients disposed within the storage compartment into the liquid in the beverage container.

An additional object of the present invention is to provide a beverage container operable to facilitate storage of a dry ingredient and provide introduction thereof into a liquid wherein the cap member is moved in a second direction so as to extract at least a portion of the cap assembly providing access to the opening of the beverage container for consumption of the liquid therein.

Yet a further object of the present invention is to provide a beverage container that is configured to provide mixing of a first ingredient into a liquid immediately prior to consumption wherein the cap member further includes extraction members configured to operably engage a portion of the storage compartment so as to provide removal thereof.

Another object of the present invention is to provide a beverage container operable to facilitate storage of a dry ingredient and provide introduction thereof into a liquid wherein the plunger member includes an embodiment that has a filter member formed on the lower portion thereof.

Still a further object of the present invention is to provide a beverage container that is configured to provide mixing of a first ingredient into a liquid immediately prior to consumption wherein the storage compartment is configured to retain and dispense dry and liquid ingredients into the liquid in the beverage container.

Yet object of the present invention is to provide a beverage container operable to facilitate storage of a dry ingredient and provide introduction thereof into a liquid wherein the cap member is configured with a stop member that provides limitation of travel of the cap member in the first direction.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
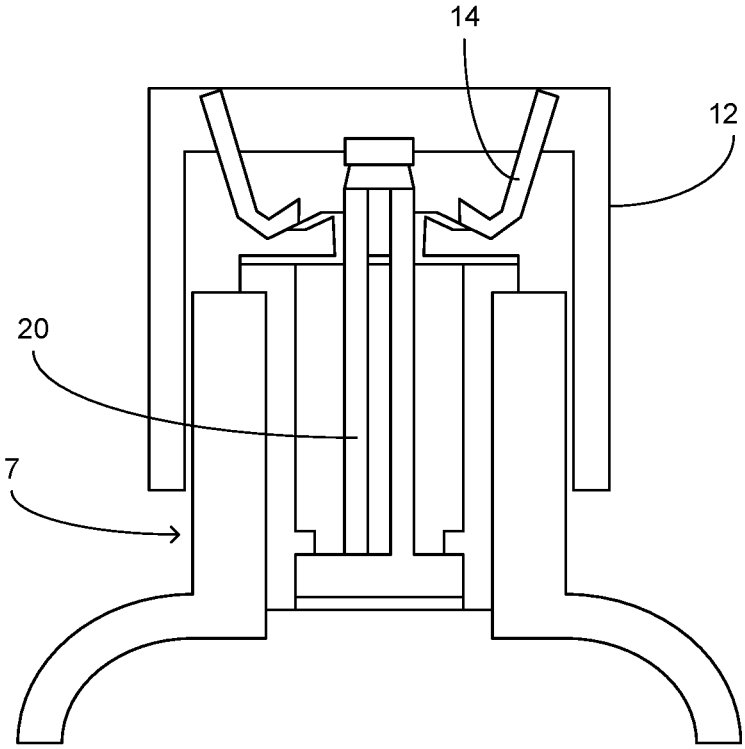
FIG. 1 is a detailed view of the cap assembly of the present invention.

Referring now to the drawings submitted herewith, wherein various elements depicted therein are not necessarily drawn to scale and wherein through the views and figures like elements are referenced with identical reference numerals, there is illustrated a beverage container 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the beverage container 100 includes a body 5 that includes an interior volume 6 that is configured to receive and retain a liquid therein. It should be understood within the scope of the present invention that the body 5 could be manufactured in alternate sizes, shapes and further be manufactured from alternate suitable materials. Releasably secured to the neck 7 of the body 5 is the cap assembly 10. The cap assembly 10 is configured to provide introduction of a material into the interior volume 6 prior to consumption of the liquid stored therein. It is contemplated within the scope of the present invention that the cap assembly 10 could be configured to introduce either a liquid material or a solid material into the interior volume 6.

The cap assembly 10 includes a cap member 12. The cap member 12 includes top 11 integrally formed with wall 12 wherein wall 12 extends downward from the top 11. The top 11 includes an inner surface 17 facing towards neck 7. Formed on the inner surface 17 extending downward therefrom are a pair of extractor members 14. As is further discussed herein the extractor members 14 are configured to operably engage the plunger keeper 25 in order to disengage the plunger keeper 25 from plunger member 20. The extractor member 14 include ends that are hook shaped so as to facilitate operable coupling with the plunger keeper 25 as illustrated herein in FIG. 12. Furthermore, the angular orientation of the extractor members 14 towards each other provides a technique to bias against the plunger keeper 25 so as to maintain engagement therewith. While a preferred embodiment of the extractor members 14 are illustrated herein, it is contemplated within the scope of the present invention that the extractor members 14 could be provided in alternate shapes in order to engage with the plunger keeper 25. Additionally, it should be understood within the scope of the present invention that as few as one extractor member 14 could be employed or more than two. The cap member 12 further includes plunger seat 16 formed on the inner surface 17. The plunger seat 16 extends downward from the inner surface 17 and is positioned to operably engage the tip 19 of the plunger member 20 wherein the cap assembly 10 is in its closed position.

Figure 6:
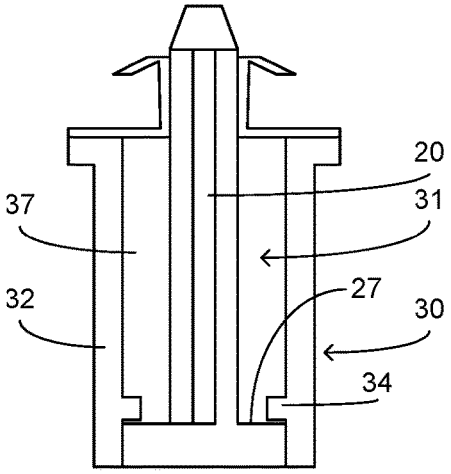
FIG. 6 is a cross-sectional view of an assembled cap storage compartment.
Figure 7:
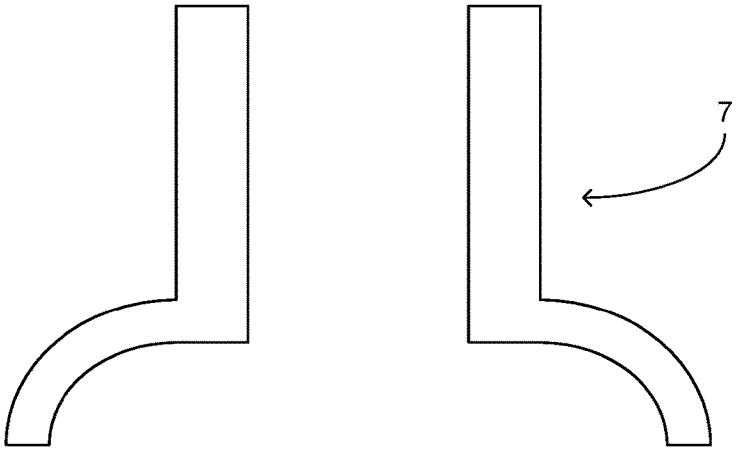
FIG. 7 is a cross-sectional view of an exemplary container neck.
Figure 8:
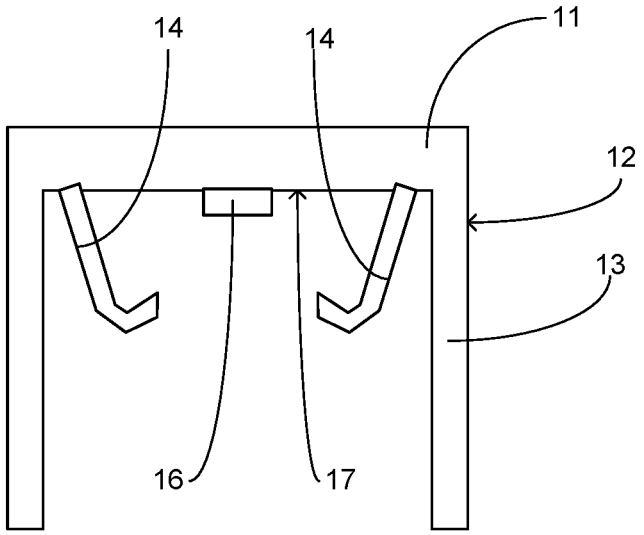
FIG. 8 is a cross-sectional view of the cap member.
Figure 9:
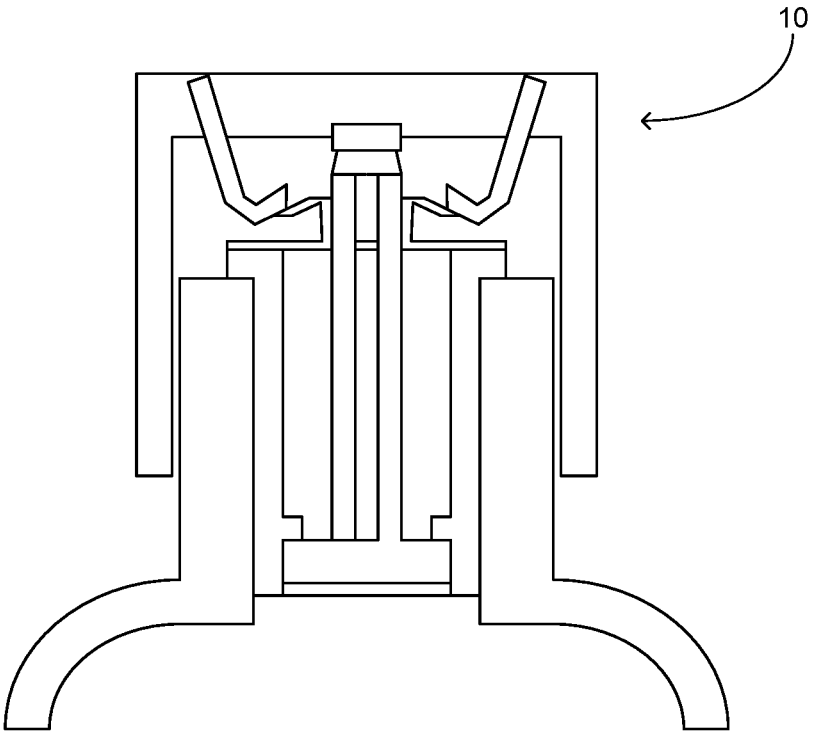
FIG. 9 is a cross-sectional view of the cap assembly.

The plunger member 20 is movably disposed within the interior volume 31 of the storage compartment 30. The plunger member 20 includes base portion 22 distally located from tip 19. The base portion 22 has a diameter sufficient to completely seal against the inner surface 37 of the wall member 32 of the storage compartment 30. Wall member 32 further includes protrusion 34 that extends inward towards the interior volume 31 and is configured to operably engage the upper surface 27 of the base portion 22 of the plunger member 20. The wall member 32 further includes lip member 38 that is perpendicular to the wall member 32 extending outward therefrom. Lip member 38 extends outward so as to engage the upper edge of neck 7 in order to maintain the position of the storage compartment 30 in the neck 7. The upper surface 27 is sealably secured against the protrusion 34 so as to isolate the interior volume 31 from the interior volume 6. The interior volume 31 is configured to have a material stored therein that is different than that of the liquid stored in the interior volume 6. FIG. 6 illustrated the position of the plunger member 20 that provides isolation of the interior volume 31 so as to not be in communication with interior volume 6. It is contemplated within the scope of the present invention that the plunger member 20 could be sealably secured utilizing alternate techniques and/or elements in order to provide the isolation of the interior volume 31 of the storage compartment 30 from the interior volume 6 of the body 5.

Figure 12:
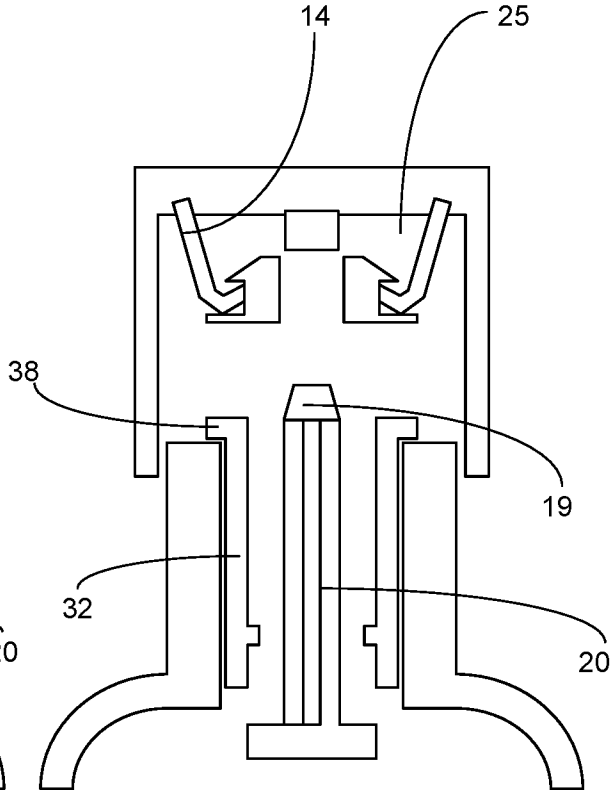
FIG. 12 is a cross-sectional view of the cap assembly with plunger keeper removed from the plunger.
Figure 11:
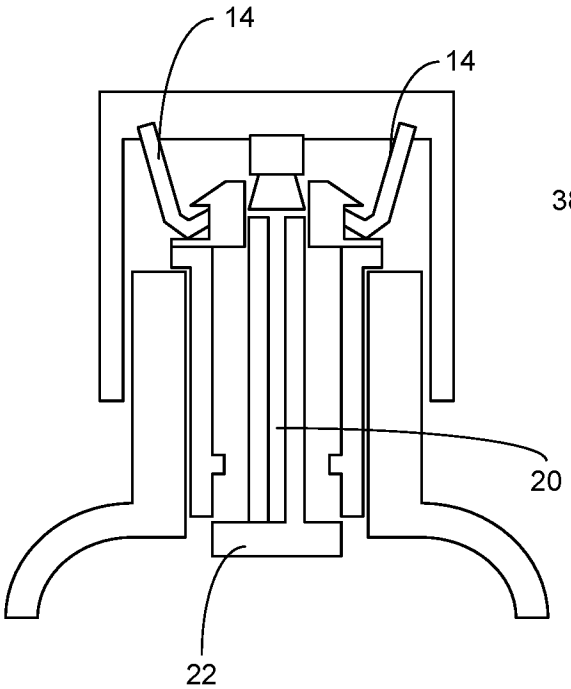
FIG. 11 is a cross-sectional view of the cap assembly with the extraction members operably coupled with the plunger keeper.
Figure 10:
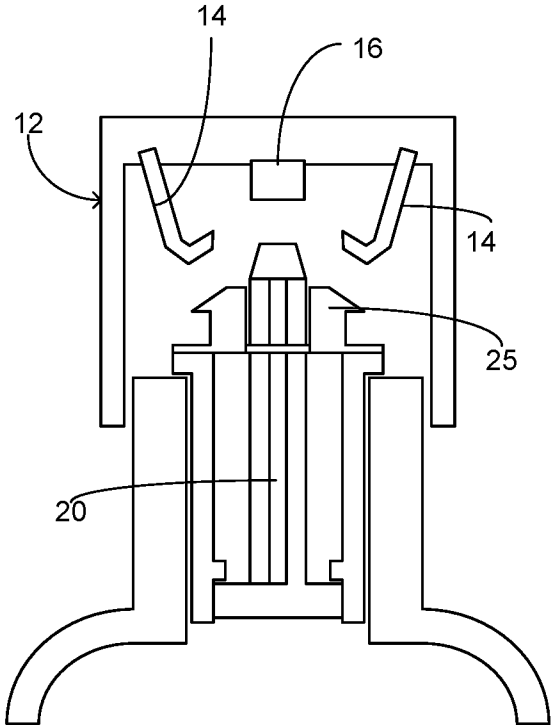
FIG. 10 is a cross-sectional view of the cap assembly with the extraction members disengaged with the plunger.

FIG. 10 through FIG. 12 illustrate an operational sequence of the cap assembly 10 for an embodiment of the present invention that releases the plunger member 20 into the interior volume 6 of the body 5. In FIG. 10 the cap member 12 is in its first position wherein the extractor member 14 are above the plunger keeper 25. In FIG. 11, the cap member 12 has been moved to its second position wherein the ends of the extractor members 14 are operably coupled with the plunger keeper 25. FIG. 12, the cap member 12 has been moved back towards and beyond its first position wherein during traversal to this position the extractor members 14 maintain engagement with the plunger keeper 25 so as to disengage from the plunger member 20. Subsequent disengagement with the plunger keeper 25, the plunger member 20 falls into the interior volume 6 and as such any material disposed within the interior volume 31 of the storage compartment 30 is deposited into the interior volume 6. A user of the beverage container 100 can agitate the body 5 is needed to mix the material deposited thereinto from the storage compartment 30 prior to consumption thereof.

Figure 2:
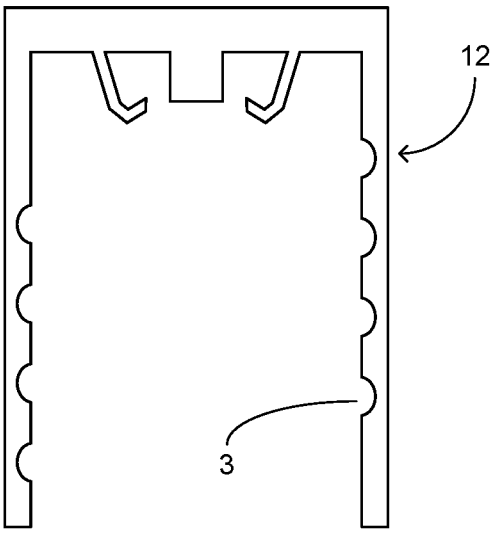
FIG. 2 is cross-sectional view of the cap member.
Figure 3:
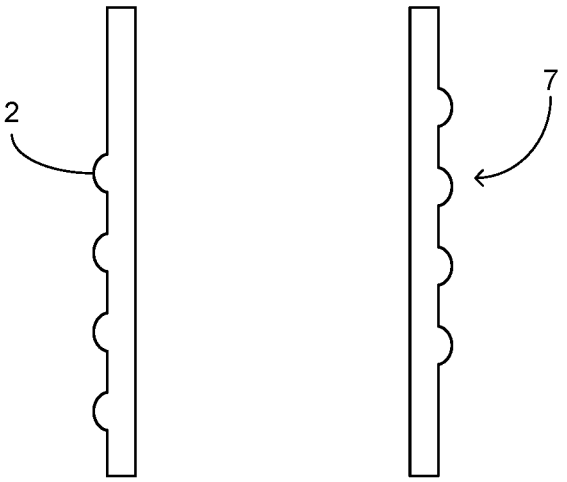
FIG. 3 is a cross-section of the neck of the beverage container.
Figure 4:
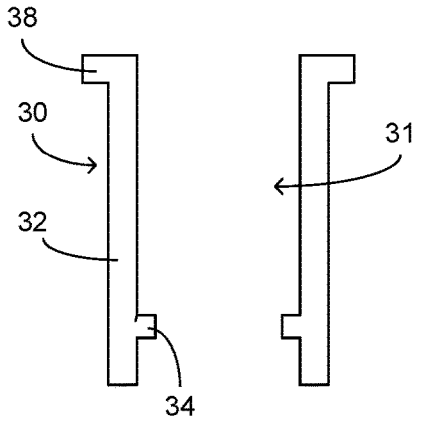
FIG. 4 is a cross-sectional view of the outer walls of the cap storage compartment.
Figure 5:
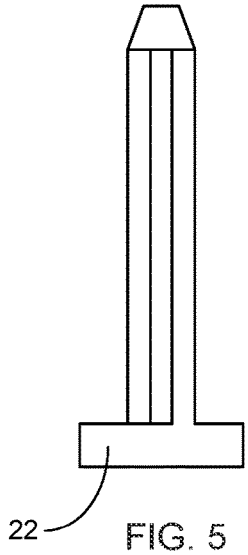
FIG. 5 is a cross-sectional view of the plunger of the cap storage compartment.

It should be recognized that many of the Figures submitted herewith do not illustrate elements to secure the cap member 12 to the neck 7. This is illustrative only and attention is called to FIG. 2 and FIG. 3 wherein threads 2 are illustrated on neck 7 that are configured to be operably engage with grooves 3 on the cap member 12. It is contemplated within the scope of the present invention that the cap member 12 could be releasably secured to neck 7 utilizing various suitable alternate elements.

FIG. 15 through FIG. 18 submitted as a part hereof illustrate an alternative embodiment of the plunger member 70 wherein the plunger member 70 is removed from the neck 90 of the body 5. Plunger member 70 includes base portion 72, stem member 73 and tip member 74. Tip member 74 is shaped having a lower perimeter edge that can be operably coupled with the extractor members 14 in order to facilitate removal of the plunger member 70. The base portion 72 is sealably coupled to inner surface 91 of the neck 90 so as to facilitate storage of materials in the interior volume 93 of the neck 90. In this embodiment, as illustrated herein in FIG. 16, the extractor members 14 are employed in combination with a first position of the cap member 12 so as to maintain the plunger member 70 in its first position wherein in the first position the plunger member 70 provides isolation of the interior volume 93. As illustrated herein in FIG. 17, ensuing movement of the cap member 12 to a second position, the plunger member 70 is traversed downward into the neck so as to move base portion 72 sufficiently to create void 77 so as to release any materials disposed in interior volume 93. The cap member 12 is subsequently moved back towards and beyond its first position so as to disengage from the neck 90 wherein the plunger member 70 maintains an operable coupling with the cap member 12 facilitating removal of the plunger member 70. A stop member 80 is formed on the grooves 3 in order to facilitate controlled rotational movement of the cap member 12.

Figure 13:
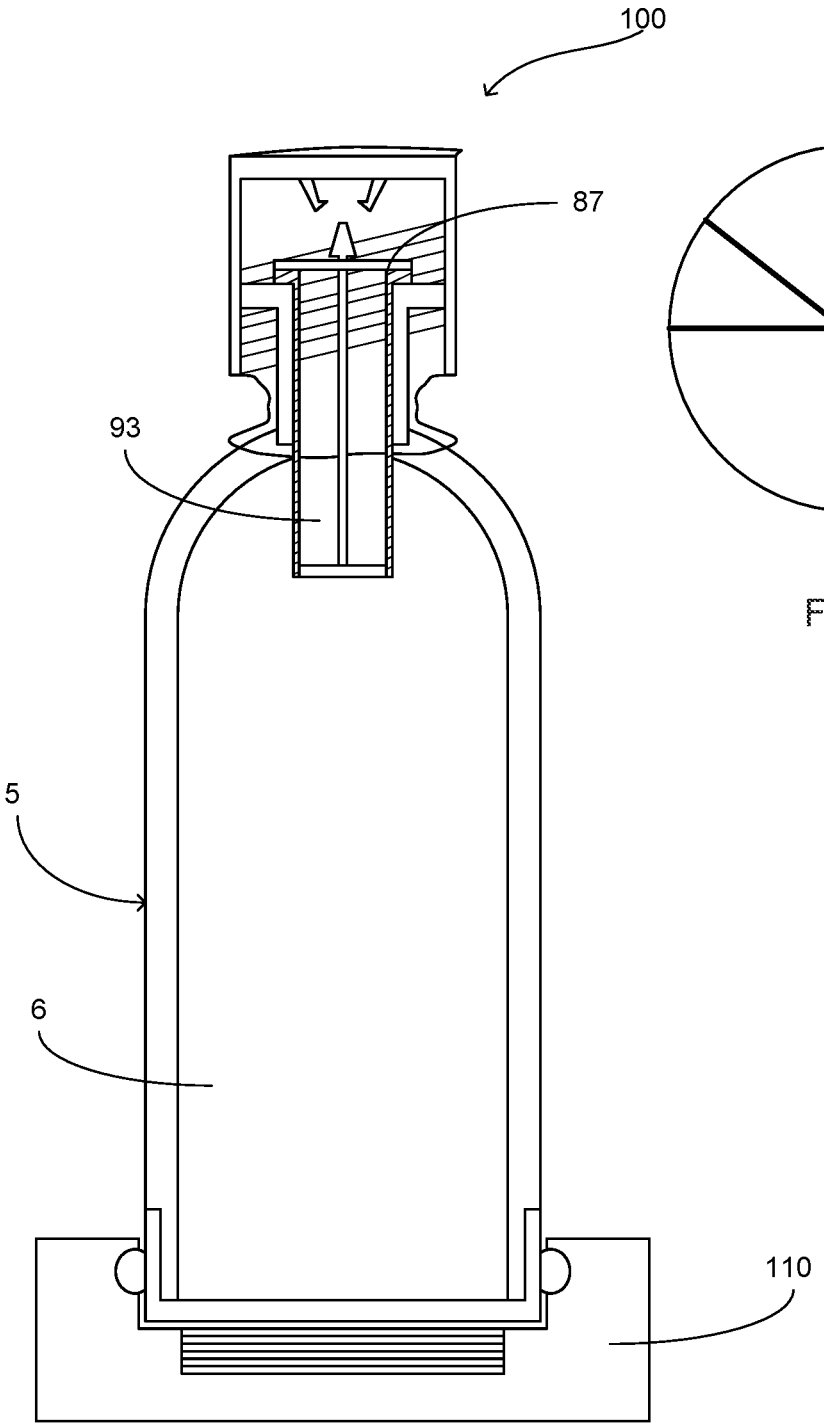
FIG. 13 is a cross-sectional of an embodiment of the present invention on a heating member.
Figure 14:
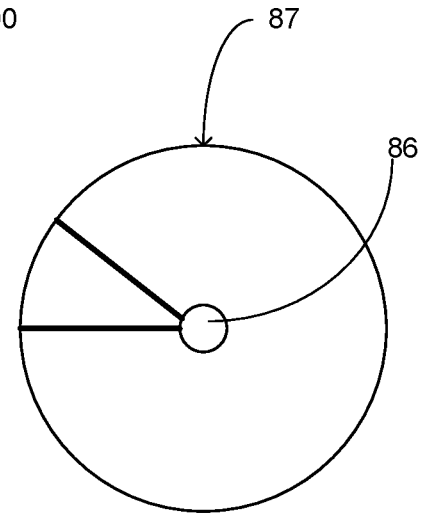
FIG. 14 is a detailed view of a sealing member.
Figure 15:
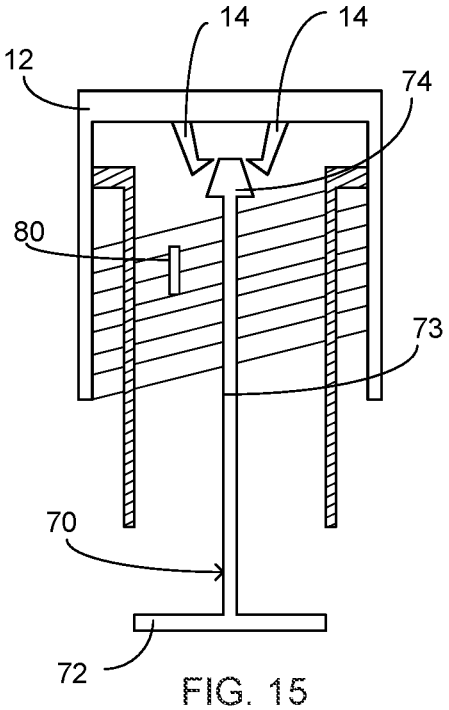
FIG. 15 is a cross-sectional view of the cap assembly with the plunger in a second position.
Figure 16:
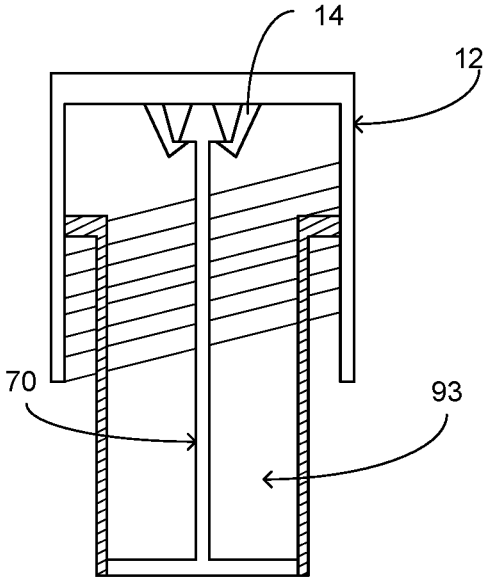
FIG. 16 is a cross-sectional view of the cap assembly with the plunger in a first position.
Figure 17:
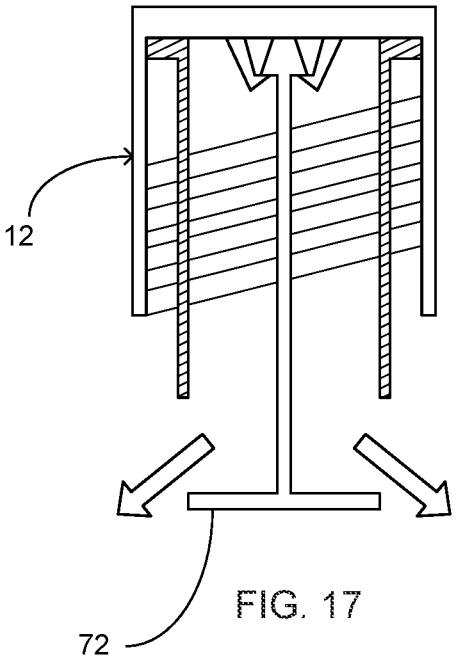
FIG. 17 is a cross-sectional view of the cap assembly with the plunger in a second position.
Figure 18:
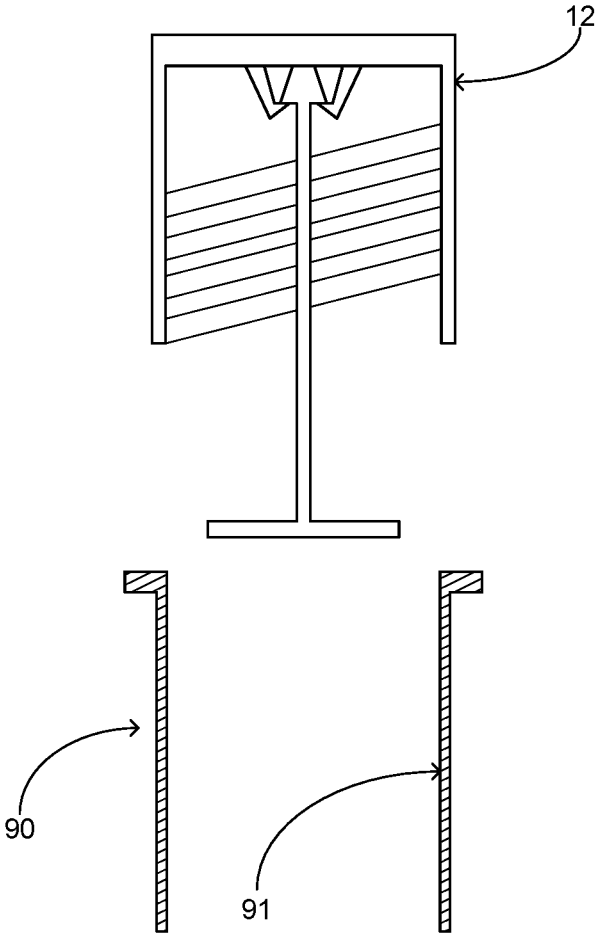
FIG. 18 is a cross-sectional view of the cap assembly with the plunger extracted from the cap assembly.

FIG. 13 illustrates a sealing member 87 operably disposed at the top of the neck 90. Sealing member 87 is deployed when the material within the interior volume 93 is a liquid. Sealing member 87 includes center aperture 86 through which stem member 73 is sealably journaled therethrough. Sealing member 87 inhibits liquid from egressing therepast when the cap member 12 is in its first position. It is contemplated within the scope of the present invention that the body 5 could be manufactured from a temperature conducting material. An exemplary temperature control unit 110 is illustrated herein in FIG. 13. The temperature control unit 110 is configured to alter the temperature of the body 5 to a temperature that is either warmer or cooler than its environment. In a preferred embodiment of the present invention, the temperature control unit 110 is a Peltier-style temperature controller.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A beverage container configured to receive and dispense a liquid wherein the beverage container further provides an isolated compartment for storage of an alternate material to be deposited into the liquid wherein the beverage container comprises:

a body, said body having at least one wall and a bottom integrally formed to create an interior volume, said interior volume configured to receive and store a liquid;

a cap assembly, said cap assembly being operably coupled to a neck of the body, said cap assembly further including a cap member, said cap member having a wall and a top wherein said wall is perpendicular to said top extending downward therefrom, said cap assembly further including a storage compartment, said storage compartment being disposed in the neck of said body, said storage compartment having a plunger member operably disposed in an interior volume thereof, said plunger member having a first portion and a second portion, said second portion being at a lower end of said plunger member, said second portion of said plunger member being perpendicular to said first portion of said plunger member, said plunger member having a first position and a second position, said second portion of said plunger member operable to sealably isolate the interior volume of the storage compartment and the interior volume of said body, said cap member having at least one extraction member formed thereon, said at least one extraction member configured to facilitate movement of the plunger member from the first position to the second position;

a plunger keeper, said plunger keeper operably coupled to said first portion of said plunger member proximate a top end thereof, said plunger keeper being surroundably mounted to said first portion of said plunger member, said plunger keeper configured to operably couple with the at least one extraction member in order to disengage said plunger keeper with said plunger member; and wherein in said second position of said plunger member said interior volume of said body is in fluid communication with the interior volume of said storage compartment.

2. The beverage container as recited in claim 1, wherein said storage compartment further includes a protrusion formed on an inner surface of the wall thereof, said protrusion projecting inwards towards the interior volume of said storage compartment.

3. The beverage container as recited in claim 2, and further including a plunger seat, said plunger seat formed on the top of said cap member on an inner surface thereof, said plunger seat configured to operably engage an upper end of said plunger member during said plunger member being in said first position.

4. The beverage container as recited in claim 3, wherein said storage compartment further includes a lip member, said lip member being proximate a top end of said storage compartment, said lip member extending outward from the wall of said storage compartment being perpendicular thereto so as to engage the neck of said body.

5. The beverage container as recited in claim 4, wherein the at least one extraction member includes an end distal to the inner surface of the top of the cap member that is hook shaped.

6. The beverage container as recited in claim 5, wherein said cap member is movable in an upwards-downwards direction along the neck of said body in order to facilitate moving the plunger member between the first position and the second position.

7. The beverage container as recited in claim 6, wherein the material disposed in the interior volume of the storage compartment is either a solid or a liquid.

8. The beverage container as recited in claim 7, wherein the neck includes thread members disposed on an outer surface thereof.

9. The beverage container as recited in claim 8, wherein the cap member includes grooves configured to operably coupled with the thread members in order to facilitate movement of the cap member.

10. The beverage container as recited in claim 9, wherein the grooves has disposed therein a stop member, said stop member configured to inhibit further rotational movement of the cap member.

11. A beverage container configured to receive and dispense a liquid wherein the beverage container further provides an isolated compartment for storage of an alternate material to be deposited into the liquid wherein the beverage container comprises:

a body, said body having at least one wall and a bottom integrally formed to create an interior volume, said body having an upper end and a lower end, said body having neck proximate said upper end, said interior volume configured to receive and store a liquid;

a cap member, said cap member having a wall and a top wherein said wall being perpendicular to said top extending downward therefrom, said top having an inner surface, said cap member being operably coupled to an exterior surface of said neck;

a pair of extraction members, said pair of extraction members being formed on the inner surface of said top, said pair of extraction members being angular in orientation towards each other, said pair of extraction members extending downward from said inner surface;

a plunger member, said plunger member being operably disposed in said bottle proximate the neck thereof, said plunger member having a first position and a second position, said plunger member operable to sealably isolate an interior volume of the neck and the interior volume of said body, said plunger member having a first end and a second end, said plunger member having a first portion and a second portion integrally formed, said second portion of said plunger member being at said second end, said second portion of said plunger member being perpendicular to said first portion and being operable to sealably isolate the interior volume of said neck, said plunger member having a tip at said first end thereof, said tip having a plunger keeper surroundably mounted thereto, said plunger keeper configured to be operably engaged by said pair of extraction members; and wherein in said second position of said plunger member said interior volume of said neck is in fluid communication with the interior volume of said body.

12. The beverage container as recited in claim as recited in claim 11, and further including a sealing member, said sealing member being mounted at an opening of said neck.

13. The beverage container as recited in claim as recited in claim 12, wherein in said second position of said plunger member said plunger member is removed from the interior volume of said neck.

14. The beverage container as recited in claim as recited in claim 13, wherein in said first position said plunger member is disposed within the interior volume of said neck.

* * * * *